United States Patent [19]

Jefferson et al.

[11] 4,348,995

[45] Sep. 14, 1982

[54] FUEL PUMPING APPARATUS

[75] Inventors: John R. Jefferson, Rainham; Alexander G. M. Brown, Maidstone, both of England

[73] Assignee: Lucas Industries Limited, Birmingham, England

[21] Appl. No.: 197,907

[22] Filed: Oct. 17, 1980

[30] Foreign Application Priority Data

Nov. 3, 1979 [GB] United Kingdom ..... 7938149

[51] Int. Cl.[3] ..... F02D 31/00

[52] U.S. Cl. ..... 123/366; 123/368; 417/462

[58] Field of Search ..... 123/366, 368, 372–374; 417/462, 214, 221

[56] References Cited

U.S. PATENT DOCUMENTS

| | | | |
|---|---|---|---|
| 3,338,168 | 8/1967 | Davis | 417/462 |
| 3,847,509 | 11/1974 | Bonin | 417/462 |
| 4,098,249 | 7/1978 | Mowbray | 417/462 |
| 4,282,844 | 8/1981 | Skinner | 123/368 |

FOREIGN PATENT DOCUMENTS

| | | | |
|---|---|---|---|
| 2803323 | 8/1978 | Fed. Rep. of Germany | 123/368 |
| 500365 | 2/1939 | United Kingdom | 123/366 |

*Primary Examiner*—Ira S. Lazarus
*Assistant Examiner*—Magdalen Moy

[57] ABSTRACT

A fuel pumping apparatus includes an injection pump and means for controlling the quantity of fuel delivered by the pump. A two speed governor including an operator adjustable control is provided to determine the setting of said means. Stop means is provided to determine the maximum amount of fuel which can be supplied by the injection pump and this is movable from a first position in which an excess of fuel can be supplied for starting purposes to a second position in which the normal maximum amount of fuel can be supplied. The stop means is moved to said first position when the operator adjustable control is moved to the engine idling position but is moved to said second position as the operator adjustable control is moved away from the idling position.

5 Claims, 5 Drawing Figures

FUEL PUMPING APPARATUS

Figure 1:
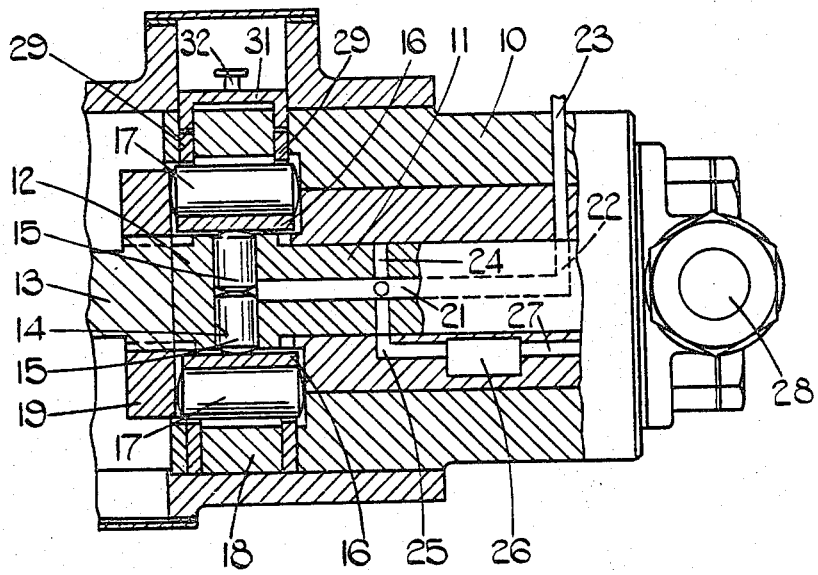

This invention relates to fuel injection pumping apparatus for supplying fuel to an internal combustion engine and of the kind comprising an injection pump operable in use in timed relationship with the associated engine, means for controlling the quantity of fuel delivered by the pump, a two speed governor for determining the setting of said means, said governor including an operator adjustable control which is movable between an engine idling position and a maximum speed position, the governor acting to control the idling speed and the maximum speed of the associated engine, the intermediate speed being determined by the setting of the control, and stop means for determining the maximum amount of fuel which can be supplied by the pump, said stop means being temporarily adjustable to enable an extra or excess amount of fuel to be delivered to the engine for starting purposes.

Various forms of apparatus of the kind specified are known in the art. In one such form the means for controlling the quantity of fuel delivered comprises an adjustable throttle which is interposed between a source of fuel at low pressure and the injection pump. The stop means may be in the form of a stop which limits the allowed movement of a pumping plunger of the injection pump or a shuttle which in conjunction with a bore in which it is mounted, acts as a temporary store for fuel before it is supplied to the injection pump. The stop may be movable to the position in which an excess of fuel is supplied by the operator or such movement may be automatic when the associated engine is stopped but in each case the stop must be returned to the normal maximum fuel position when the engine has started. Such movement must be automatic to ensure that no more than the correct maximum amount of fuel is supplied when the engine is in use. Moreover, it is necessary to ensure that the operator cannot move the stop whilst the engine is running. It is known to use a pressure responsive piston to control the position of the stop, the piston being responsive to the pressure developed by a low pressure pump incorporated in the apparatus and forming said source of low pressure fuel. The piston and associated cylinder can take up a good deal of space and require expensive machining operations in their construction. It is also known to make use of the speed responsive means of the governor but this arrangement, which is also known in apparatus of the type in which the means for varying the amount of fuel is an axially movable control rod, involves additional linkage in the governor and it may require the force capable of being produced by the governor, to be increased. In order to avoid the aforesaid problems it is proposed to utilise the movement of the operator adjustable control to determine the setting of the stop means. This is only possible where the governor is of the two speed type as will be explained. Whilst additional linkage may be required the forces required to operate the stop means do not influence the governor and the problems of finding space for and making the piston and cylinder, do not arise.

According to the invention an apparatus of the kind specified is characterized by linkage means connecting said operator adjustable control to said stop means whereby said stop means is moved to a first position in which an excess of fuel can be delivered when the operator adjustable control is moved to the aforementioned idling position, and is moved away from said first position to a second position in which only the normal maximum amount of fuel can be delivered, as the operator adjustable control is moved away from the engine idling position.

Figure 2:
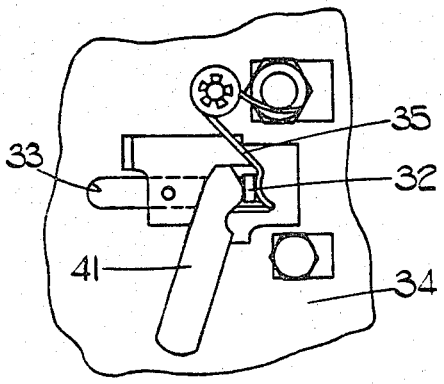
Figure 3:
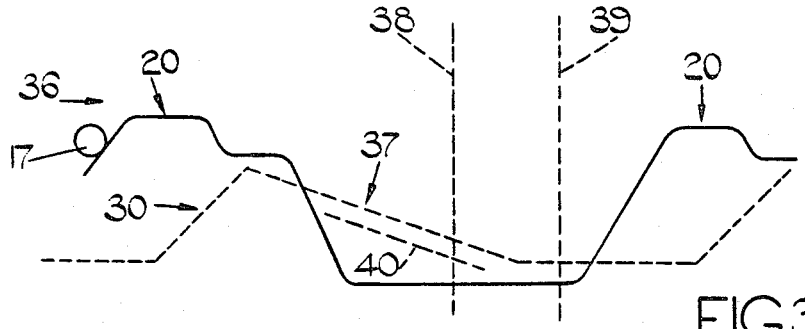
Figure 4:
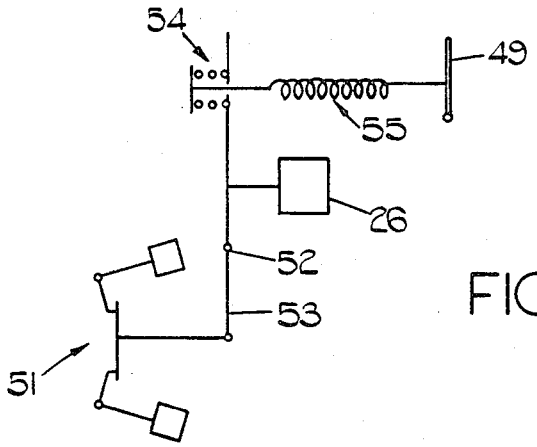
Figure 5:
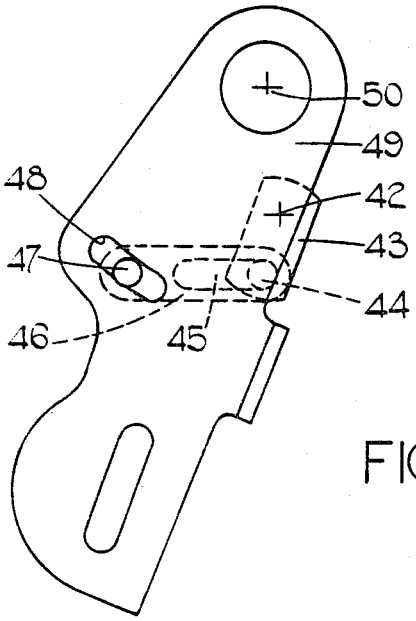

An example of a pumping apparatus in accordance with the invention will now be described with reference to the accompanying drawings in which:

FIG. 1 is a diagrammatic sectional side elevation of an apparatus in accordance with the invention, FIG. 2 is a plan view of a part of the apparatus not seen in FIG. 1, FIG. 3 is a diagram of the cam lobe profile and a profile of a stop ring forming part of the apparatus seen in FIG. 1, FIG. 4 is a diagrammatic view of a two speed mechanical governor capable of being used in the apparatus shown in FIG. 1, and FIG. 5 is a plan view of part of the apparatus not shown in FIG. 1.

Referring to FIG. 1 of the drawings the apparatus comprises a multi-part body 10 in which is mounted a rotary cylindrical distributor member 11. The distributor member has an enlarged portion 12 which is driven from a drive shaft 13 which in use is driven in timed relationship with the associated engine. Formed in the distributor member 11 is a diametrically disposed bore 14 in which is mounted a pair of plungers 15 and these at their outer ends, engage shoes 16 which carry rollers 17 respectively which engage the internal peripheral surface of an annular cam ring 18 surrounding the enlarged portion 12 of the distributor member.

The cam ring has a plurality of inwardly extending cam lobes the profile of which is seen at 20 in FIG. 3. The shoes 16 are carried in slots formed in a sleeve 19 which is secured to or forms part of the drive shaft 13.

Formed within the distributor member is a longitudinal passage 21 which at one end communicates with a radially disposed delivery passage 22. The passage 22 is disposed to register in turn with outlet ports 23 formed in the body and connected in use, to the injection nozzles respectively of the associated engine. The longitudinal passage 21 also communicates with a plurality of inlet passages 24 formed in the distributor member and arranged to communicate in turn with an inlet port 25 which is formed in the body. The inlet port 25 communicates by way of the fuel control device 26 which conveniently comprises an adjustable throttle, with a fuel supply passage 27. This passage communicates with a low pressure supply pump the rotary part of which is carried by the distributor member. The low pressure pump draws fuel through a fuel inlet 28.

In operation, when the rollers and plungers are moved inwardly by the action of the lobes, fuel is displaced through an outlet 23 and as the distributor member rotates further, the delivery passage 22 is moved out of register with an outlet 23 and one of the inlet passages 24 moves into register with the inlet port 25. Fuel can now flow to the bore 14, the amount of fuel being controlled by the setting of the throttle. Thereafter the cycle is repeated and fuel is supplied to the outlets in turn during successive inward movements of the plungers.

In order to control the maximum amount of fuel which can be supplied by the apparatus to the associated engine irrespective of the setting of the throttle, there is mounted in the body a pair of stop rings 29, these rings being disposed on opposite sides of the cam ring 18. The rings 29 are angularly movable within the body and have an internal profile as shown at 30 in FIG. 3. The stop rings are interconnected by means of a bridging member 31 which is provided with an upstanding peg 32. The peg 32 extends through a slot 33 formed in a plate 34 as seen in FIG. 2. The peg 32 is engaged by a resilient means in the form of a helical torsion spring 35 and this urges the stop rings 29 to a position in which the apparatus is able to deliver the normal maximum amount of fuel to the associated engine.

If we turn to FIG. 3 which explains the action of the stop rings, a roller 17 is shown engaging one of the cam lobes and the directon of movement of the roller as it is driven around the cam ring is shown by the arrow 36. It will be seen that the roller is engaging the leading flank of the cam lobe. The roller will also move upwardly as shown in FIG. 3 and this corresponds to inward movement of the associated plunger 15. Fuel is therefore being supplied through an outlet 23 and when the roller reaches the crest of the cam lobe there is a delay during which no movement of the plunger takes place. This is followed by a limited outward movement of the plunger to reduce the pressure in the various passages within the pump and also reduce the pressure in the pipeline connecting the outlet with the nozzle. Again there is a short delay during which time the delivery passage 22 moves out of register with an outlet port 23 and an inlet passage 24 moves into register with the inlet port 25. The cam lobe falls to the base circle of the cam and the plunger can therefore move outwardly as fuel is supplied from the low pressure source.

The internal profile of the stop rings is shown at 30 and the important portion thereof is a portion 37 with which the roller 17 can engage during the period when fuel can be supplied to the bore. The dotted line 38 indicates the closure of the inlet port 25 to an inlet passage and the further dotted line 39 indicates the opening of the delivery passage to an outlet 23. Assuming for the moment that the throttle is set so that there is substantially no restriction to the flow of fuel then the roller will engage the portion 37 of the internal peripheral surface of the stop rings to restrain the outward movement of the rollers and therefore the plungers. Once the inlet port has been closed then no further fuel can be supplied to the bore and the position of the rollers and plungers will be such that the maximum amount of fuel is supplied by the pump to the associated engine. At least the plungers will be held against movement until the rollers again engage the leading flanks of the cam lobes 20. It will be noted that before they do this the delivery passage 22 will be brought into communication with the outlet 23. Furthermore, it should be noted that if the throttle which forms part of the device 26 is set to allow a restricted supply of fuel then the rollers may not engage with the portion 37 of the stop rings.

If the stop rings are moved anularly then the maximum amount of fuel which can be supplied to the engine will vary and if they are moved to the position shown by the dotted line 40 in FIG. 3 and additional or excess amount of fuel will be supplied to the engine. The setting of the peg shown in FIG. 2 corresponds to the excess fuel setting and the peg and therefore the bridging member, are maintained in this position by the action of a lever 41 which engages the peg and which forms part of a linkage to be described.

Turning now to FIG. 5 the lever 41 is connected to an angularly movable shaft the axis of movement of which is indicated by the cross referenced 42. This shaft carries a further lever 43 which is provided with an upstanding peg 44 located within a slot 45 formed in a further lever 46. This lever is pivotally connected to a pin 47 which is adjustably mounted within an arcuate slot 48 formed in a lever 49 pivotally mounted about an axis indicated at 50. The lever 49 is connected to the throttle pedal of the vehicle and it is biassed to the position shown in FIG. 5 by resilient means not shown. As seen in FIG. 5 the lever 49 is in the idling position. With the lever 49 in the idling position, the lever 41 engages the peg 32 and moves the bridging member so that the stop rings 29 are in a position to allow an excess of fuel to be supplied to the engine for starting purposes. When the engine staerts and the operator moves the lever 49 to increase the amount of fuel supplied to the engine, the spring 35 moves the bridging member towards a position in which the normal maximum amount of fuel can be supplied to the engine and this is achieved by angular movement of the lever 43 and therefore the lever 41. The levers 41 and 43 can undergo limited angular movement only and the slot 45 in the lever 46 permits the lever 49 to continue its movement as required by the operator, without imparting movement to the lever 43. The lever 46 conveniently has its end remote from the pin 47 bifurcated and is formed from resilient material. This has the effect of minimising the loading on the various levers when the throttle pedal is suddenly moved to the idling position. A spring may be provided to bias the peg 44 towards the end of the slot.

Turning now to FIG. 4, this shows a two speed governor mechanism for use with the apparatus shown in FIG. 1. As will be seen in FIG. 4 the lever 49 is illustrated as also is the control device or throttle 26. A centrifugal weight mechanism generally indicated at 51 is provided and conveniently this is mounted on the drive shaft 13 of the apparatus. As the speed of rotation of the shaft increases, the weights move outwardly and effect anticlockwise movement about a pivot 52, of a lever 53. This lever is connected to the control device 26 the arrangement being that as the weights move outwardly the degree of restriction offered by the control device is increased so that less fuel is supplied to the associated engine.

The movement of the lever 53 by the weight mechanism 51 is opposed by the action of a pair of springs and is intended to provide for control of the engine idling speed at which speed in conjunction with the weight mechanism, it constitutes a low speed governor. The spring 55 is shown as a tension spring and it is a preloaded spring and only extends when the speed of the associated engine is approaching its maximum value. Below this speed therefore it constitutes a substantially solid link between the lever 49 and the lever 53. It should be appreciated that above idling speed the spring 54 will be compressed its maximum amount. The governor mechanism described constitutes a two speed governor since it controls the idling speed of the engine and also controls the maximum speed of the engine. At intermediate speeds the amount of fuel supplied to the engine is dependant only upon the position of the lever 49.

Considering now the operation of the apparatus as a whole, when the lever 49 is set in the idling position, the lever 41 will have moved the stop rings to a position in which an excess of fuel can be supplied to the engine. Moreover, the governor spring 54 will have moved the lever 53 and the throttle to a position in which substantially no restriction is offered to the flow of fuel. When the associated engine is cranked for starting purposes the excess amount of fuel will be supplied and eventually the engine will start. Assuming for the moment that the position of the lever 49 is not altered by the operator, the weights will move outwardly against the action of the spring 54 and the amount of fuel supplied to the engine will be reduced to very much less than the excess amount of fuel supplied for starting purposes, and also less than the normal maximum amount. If now the operator moves the lever 49 to increase the amount of fuel supplied to the engine the stop rings 29 will be moved to the position such that only the normal maximum amount of fuel can be supplied.

The movement of the lever 49 required to allow movement of the rings to the normal maximum fuel position is of the order of 10° and so the rings will be in this position well before the throttle can be altered to allow this amount of fuel.

In order to prevent the possibility of excess fuel being supplied because the rings 29 have not been moved, a peg (now shown) may be provided on the lever 43 and which is positioned so as to prevent movement of the lever 46 in the event that the lever 43 does not move or is held against movement as the lever 49 is moved.

It is important that the governor should be a two-speed governor and not an all speed governor because in the latter case the governor can call for maximum fuel when the operator moves the throttle pedal even a small amount. Hence it would be possible for the governor to call for maximum fuel before the rings 29 had moved to the position to limit the fuel to the normal maximum amount. This is not the case with a two speed governor where the position of the lever 49 between idling and maximum speeds determines the amount of fuel supplied to the engine.

We claim:

1. A fuel injection pumping apparatus for supplying fuel to an internal combustion engine and of the kind comprising an injection pump operable in use in timed relationship with the associated engine, means for controlling the quantity of fuel delivered by the pump, a two speed governor for determining the setting of said means, said governor including an operator adjustable control which is movable between an engine idling position and a maximum speed position, the governor acting to control the idling speed and the maximum speed of the associated engine, the intermediate speed being determined by the setting of the control, and stop means for determining the maximum amount of fuel which can be supplied by the pump, said stop means being temporarily adjustable to enable an extra or excess amount of fuel to be delivered to the engine for starting purposes, characterised by linkage means connecting said operator adjustable control to said stop means whereby said stop means is moved to a first position in which an excess of fuel can be delivered when the operator adjustable control is moved to the aforementioned idling position, and is moved away from said first position to a second position in which only the normal maximum amount of fuel can be delivered, as the operator adjustable control is moved away from the engine idling position.

2. An apparatus according to claim 1 including resilient means biassing said stop means to said second position.

3. A fuel injection pumping apparatus for supplying fuel to an internal combustion engine and of the kind comprising an injection pump operable in use in timed relationship with the associated engine, means for controlling the quantity of fuel delivered by the pump, a two speed governor for determining the setting of said means, said governor including an operator adjustable control which is movable between an engine idling position and a maximum speed position, the governor acting to control the idling speed and the maximum speed of the associated engine, the intermediate speed being determined by the setting of the control, and stop means for determining the maximum amount of fuel which can be supplied by the pump, said stop means being temporarily adjustable to enable an extra or excess amount of fuel to be delivered to the engine for starting purposes, characterized by linkage means connecting said operator adjustable control to said stop means whereby said stop means is moved to a first position in which an excess of fuel can be delivered when the operator adjustable control is moved to the aforementioned idling position, and is moved away from said first position to a second position in which only the normal maximum amount of fuel can be delivered, as the operator adjustable control is moved away from the engine idling positon, and resilient means biasing said stop means to said second position, said linkage means comprising first and second levers, said first lever being pivotally connected to the operator adjustable control and said second lever being operatively connected to said stop means, said levers being interconnected by a pin and slot connection, whereby as said control is moved from the engine idling position and after said stop means has attained said second position, continued movement of the control can take place without imparting movement to said second lever.

4. An apparatus according to claim 6 in which said operator adjustable control comprises a third lever and the pivot connection between the first and third levers is adjustable.

5. An apparatus according to any one of the claims 1, 2, 4 or 6 in which the apparatus is of the rotary distributor type, the injection pump including at least one outwardly movable plunger and a cam ring including inwardly directed cam lobes operable to effect inward movement to the plunger, said stop means comprising an angularly adjustable ring having a shaped internal profile and operable to limit the outward movement of the plunger.

* * * * *